US006855227B2

(12) United States Patent
Beck

(10) Patent No.: US 6,855,227 B2
(45) Date of Patent: Feb. 15, 2005

(54) PAPER MACHINE AND METHOD OF DEWATERING A FIBER WEB USING DISPLACEMENT PRESSING AND THROUGH AIR DRYING

(75) Inventor: David Beck, Appleton, WI (US)

(73) Assignee: Voith Paper Patent GmbH, Heidenheim (DE)

( * ) Notice: Subject to any disclaimer, the term of this patent is extended or adjusted under 35 U.S.C. 154(b) by 92 days.

(21) Appl. No.: 10/355,405

(22) Filed: Jan. 31, 2003

(65) Prior Publication Data

US 2004/0149405 A1 Aug. 5, 2004

(51) Int. Cl.[7] ..... D21F 3/00

(52) U.S. Cl. ..... 162/109; 162/111; 162/113; 162/117; 162/204; 162/205; 162/206; 162/207; 162/289; 162/290; 162/297; 162/361; 162/363; 162/375; 162/358.1

(58) Field of Search ..... 162/109, 111, 162/113, 117, 204, 205, 207, 206, 289, 290, 297, 358.1, 361, 363, 375

(56) References Cited

U.S. PATENT DOCUMENTS

| | | | | | |
|---|---|---|---|---|---|
| 6,096,169 | A | * | 8/2000 | Hermans et al. | 162/115 |
| 6,149,767 | A | * | 11/2000 | Hermans et al. | 162/109 |
| 6,190,506 | B1 | * | 2/2001 | Beck | 162/357 |
| 6,228,220 | B1 | * | 5/2001 | Hada et al. | 162/203 |
| 6,306,257 | B1 | * | 10/2001 | Hada et al. | 162/290 |
| 6,458,246 | B1 | * | 10/2002 | Kanitz et al. | 162/280 |
| 6,475,343 | B1 | * | 11/2002 | Grabscheid et al. | 162/207 |
| 6,610,173 | B1 | * | 8/2003 | Lindsay et al. | 162/109 |

* cited by examiner

*Primary Examiner*—Peter Chin
(74) *Attorney, Agent, or Firm*—Taylor & Aust, P.C.

(57) ABSTRACT

A method of dewatering a fiber web in a paper machine, includes the steps of: dewatering the fiber web in a forming section to a solids content of greater than approximately 10%; displacement pressing the fiber web in an air press assembly to a solids content of greater than approximately 40%; and through air drying the fiber web in at least one air press assembly to a higher solids content.

31 Claims, 3 Drawing Sheets

PAPER MACHINE AND METHOD OF DEWATERING A FIBER WEB USING DISPLACEMENT PRESSING AND THROUGH AIR DRYING

BACKGROUND OF THE INVENTION

1. Field of the Invention

The present invention relates to paper machines, and, more particularly, to a method of dewatering a fiber web in a paper machine.

2. Description of the Related Art

A paper machine typically includes a number of discrete sections, including a press section and a drying section. A press section mechanically displaces water from the fiber web. Examples of known press assemblies include a nip press, an extended nip press and a shoe press.

The drying section typically includes a plurality of heated cylinders and the fiber web wraps around a relatively large portion of the periphery of each cylinder. In one known arrangement, the dryer section includes an upper and a lower row of drying cylinders which are arranged in a zig zag manner relative to each other so that the fiber web is likewise transported in a zig zag manner from an upper cylinder to a lower cylinder, and so on. Heat is primarily transferred from the drying cylinder to the fiber web via conduction. The heated fiber web causes water to be evaporated which thereby increases the solids content of the fiber web. A dryer arrangement of this type typically requires a relatively large amount of floor space within the paper making facility.

What is needed in the art is a paper machine which effectively dewaters a fiber web with low energy and minimum space requirements.

SUMMARY OF THE INVENTION

The present invention provides a method of dewatering a fiber web using displacement pressing in an air press and subsequent through air drying in an air press.

The invention comprises, in one form thereof, a method of dewatering a fiber web in a paper machine, including the steps of: dewatering the fiber web in a forming section to a solids content of greater than approximately 10%; displacement pressing the fiber web in an air press assembly to a solids content of greater than approximately 40%; and through air drying the fiber web in at least one air press assembly to a higher solids content.

The invention comprises, in another form thereof, a method of dewatering a fiber web in a paper machine, including the steps of: mechanically displacing water from the fiber web in a press assembly to a solids content of greater than approximately 40%; and evaporating water from the fiber web in at least one air press assembly to a higher solids content.

An advantage of the present invention is that the fiber web is provided with improved softness, bulk, hand feel, absorbency, and an open three dimensional structure.

Another advantage is the dewatering method of the present invention has a reduced fiber demand of approximately 15 to 20%.

Yet another advantage is the dewatering method of the present invention provides very high drying rates of approximately 400 to 950 kg water/$m^2$ hr.

A further advantage is that the high dewatering rates make it possible to eliminate mechanical press dewatering.

A still further advantage is that the fiber web can be molded with a three dimensional surface for improved absorption.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
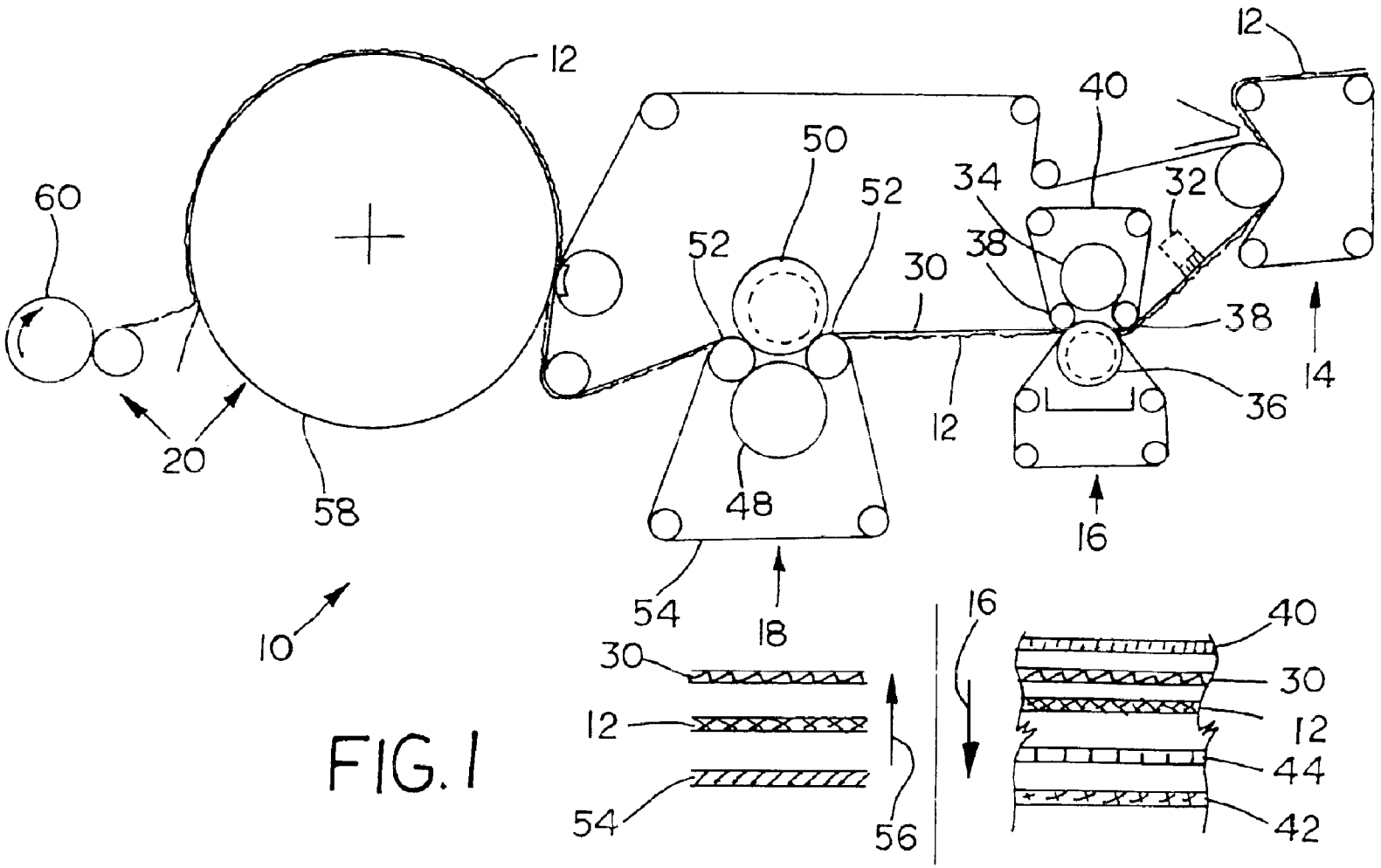
FIG. 1 is a schematic illustration of an embodiment of a paper machine of the present invention.

Referring now to the drawings, and more particularly to FIG. 1, there is shown an embodiment of a paper machine 10 of the present invention for dewatering a fiber web, designated generally by dash line 12. The term "paper machine", as used herein, is intended to mean a machine for the production of a fiber web such as a paper web, tissue web or cardboard web. Paper machine 10 is particularly useful for the production of a tissue web, which is assumed for description purposes herein. Paper machine 10 generally includes a forming section 14, displacement press assembly 16, through air drying (TAD) air press assembly 18, and additional downstream processing equipment 20.

Forming section 14 receives a uniformly distributed fiber suspension thereon from a fiber source such as a head box for the like. Water is removed from the fiber suspension primarily via gravitational porous in forming section 14. Forming section 14 includes a wire, such as a porous sheet or a woven porous fabric, through which water drains. Forming section 14 may also include a moulding fabric for imparting a non-flat, three dimensional surface structure to the fiber web, as will be described in more detail hereinafter. Dewatering of the fiber web in forming section 14 typically results in the fiber web having a solids content of greater than 10%, preferably between 10% to 30%, and more preferably approximately 15%.

Figure 4:
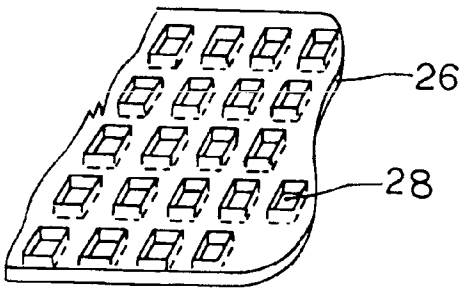
FIG. 4 is a perspective view of another embodiment of a moulding fabric which may be used with the present invention.
Figure 3:
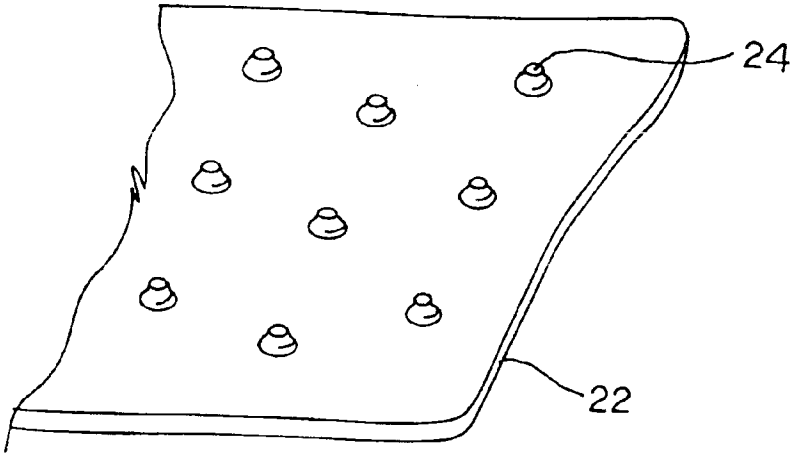
FIG. 3 is a perspective view of a moulding fabric which may be used with the present invention.

Throughout the description of paper machine 10 and the corresponding method of dewatering using paper machine 10, reference is made to a moulding fabric for imparting a non-flat, three dimensional surface structure to fiber web 12. Examples of two moulding fabrics which may be used to form the three dimensional surface structure in fiber web 12 are illustrated in FIGS. 3 and 4. Moulding fabric 22 shown in FIG. 3 is a fine mesh screen having a plurality of raised projections 24. Projections 24 may occupy less than or equal to 40% of the surface area of moulding fabric 22, preferably occupying approximately 20% to 30% of the surface area of moulding fabric 22, and more preferably occupying approximately 25% of the surface area of moulding fabric 22.

Moulding fabric 26 shown in FIG. 4 has a thickness d which may be, e.g., between approximately 1 to 3 millimeters. Moulding fabric 26 includes a plurality of holes 28 which occupy more than approximately 50% of the surface area of moulding fabric 26, more preferably occupy greater than 60% of the surface area of moulding fabric 26, and more preferably occupy between approximately 70% to 75% of the surface area of moulding fabric 26.

Any type of moulding fabric which imparts a non-flat, three dimensional surface structure to fiber web 12 may be used with paper machine 10 of the present invention. Moulding fabrics 22 and 26 shown in FIGS. 3 and 4, respectively, are merely examples. For details of moulding fabrics and corresponding operating parameters associated therewith, reference is hereby made to co-pending U.S. patent application Ser. No. 10/056,489, filed Jan. 24, 2002, which is likewise assigned to the assignee of the present invention.

Fiber web 12 is carried from forming section 14 by moulding fabric 30. Alternatively, moulding fabric 30 may be a different type of porous fabric. Moulding fabric 30 carries fiber web 12 past a wet moulding box 32 and then to displacement press assembly 16.

Displacement press assembly 16 includes an upper main roll 34, a lower vented roll 36 and a pair of cap rolls 38. An impermeable membrane 40 wraps around cap rolls 38 and main roll 34. Moulding fabric 30 passes under cap rolls 38 and across the top of vented roll 36, carrying fiber web 12 on the bottom side thereof. Vented roll 36 directly carries an air diffusion member, such as an air diffusion fabric or shrink wrap air diffusion sleeve, allowing air to diffuse into air flow channels formed in vented roll 36. Vented roll 36 also carries an anti-rewet fabric 44 which is configured to allow one way flow of water from fiber web 12 into vented roll 36. The particular orientation of impermeable membrane 40, moulding fabric 30, fiber web 12, ant-rewet fabric 44 and air diffusion member 42 is shown in FIG. 1 below displacement press assembly 16, with the direction of air flow being indicated by arrow 46.

After being pressed in displacement press assembly 16, fiber web 12 is carried on the bottom side of moulding fabric 32 to TAD air press assembly 18.

TAD air press assembly 18 includes a lower main roll 48, top vented roll 50 and cap rolls 52. A resistive fabric 54 wraps around cap rolls 52 and is carried across the bottom of vented roll 50 at the bottom side of fiber web 12. Moulding fabric 30 and fiber web 12 are carried across the top of cap rolls 52 and the bottom of vented roll 50, with fiber web 12 being interposed between moulding fabric 30 and resistive fabric 54. Resistive fabric 54 is a course fabric allowing air to flow therethrough. The particular orientation of resistive fabric 54, fiber web 12 and moulding fabric 30 are shown in FIG. 1 below TAD air press assembly 18, with the air flow direction being indicated by arrow 56.

Fiber web 12 is carried from TAD air press assembly 18 on the bottom of moulding fabric 30 to additional downstream processing equipment 20. In the embodiment shown, additional downstream processing equipment 20 includes a yankee cylinder 58 and a reel spool 60. Yankee cylinder 58 has a large diameter and corresponding large travel path for further drying fiber web 12. The dried fiber web 12 is then wound onto reel spool 60.

During operation, water is removed from the fiber suspension in forming section 14 primarily via gravitational force. The fiber suspension may be carried by a wire, forming fabric, etc., and preferably is carried by a moulding fabric. Fiber web 12 is then transferred to moulding fabric 30, where it is carried to wet moulding box 32 and then displacement press assembly 16. High pressure air is present in the pressure chamber defined between main roll 34, vented roll 36 and cap rolls 38. This high pressure air flows through moulding fabric 30, fiber web 12, anti-rewet fabric 44, and air diffusion member 42 to vented roll 36. The water is drawn through secondary flow channels formed in the roll cover 36, and then flows through the secondary flow channels to a plurality of main flow channels formed in the roll shell. The main flow channels extend to the axial ends of vented roll 36. The water flows from the ends of the tubes and/or through the radial portions of vented roll 36 outside the area of fiber web 12. The water may be collected in a save-all pan shown below vented roll 36 for further processing, use, or discarding.

The displacement pressing by air pressure which occurs within displacement air press assembly 16 results in the fiber web having a solids content of greater than approximately 40%, preferably greater than approximately 45%, more preferably greater than approximately 50%, and even more preferably greater than approximately 60%.

In the embodiment shown, TAD air press assembly 18 is in the form of a cluster press. However, TAD air press assembly 18 may also be configured as a U-shaped box, a vented roll with a hood, a suction roll, or other suitable TAD air press assembly arrangement.

TAD air press assembly 18 is configured as a cluster press arrangement in the embodiment shown so that higher pressures and air flow rates may be utilized to improve drying of fiber web 12. The air pressure within the pressure chamber defined between main roll 48, vented roll 50 and cap rolls 52 results in a differential pressure on opposite sides of fiber web 12 of greater than 2 pounds per square inch (psi), preferably with a differential pressure of between approximately 5 to 50 psi, and more preferably a differential pressure between approximately 4 to 6 psi.

TAD air press assembly 18 also allows fiber web 12 to be dewatered at a rate of between approximately 400 to 950 kg water/$m^2$ hr. This is substantially higher than conventional TAD air press assemblies having a maximum dewatering rate of less than 300 kg water/$m^2$ hr. Further, TAD air press assembly allows fiber web 12 to be dewatered to a solids content of at least approximately 80%, preferably approximately 90%.

Figure 2:
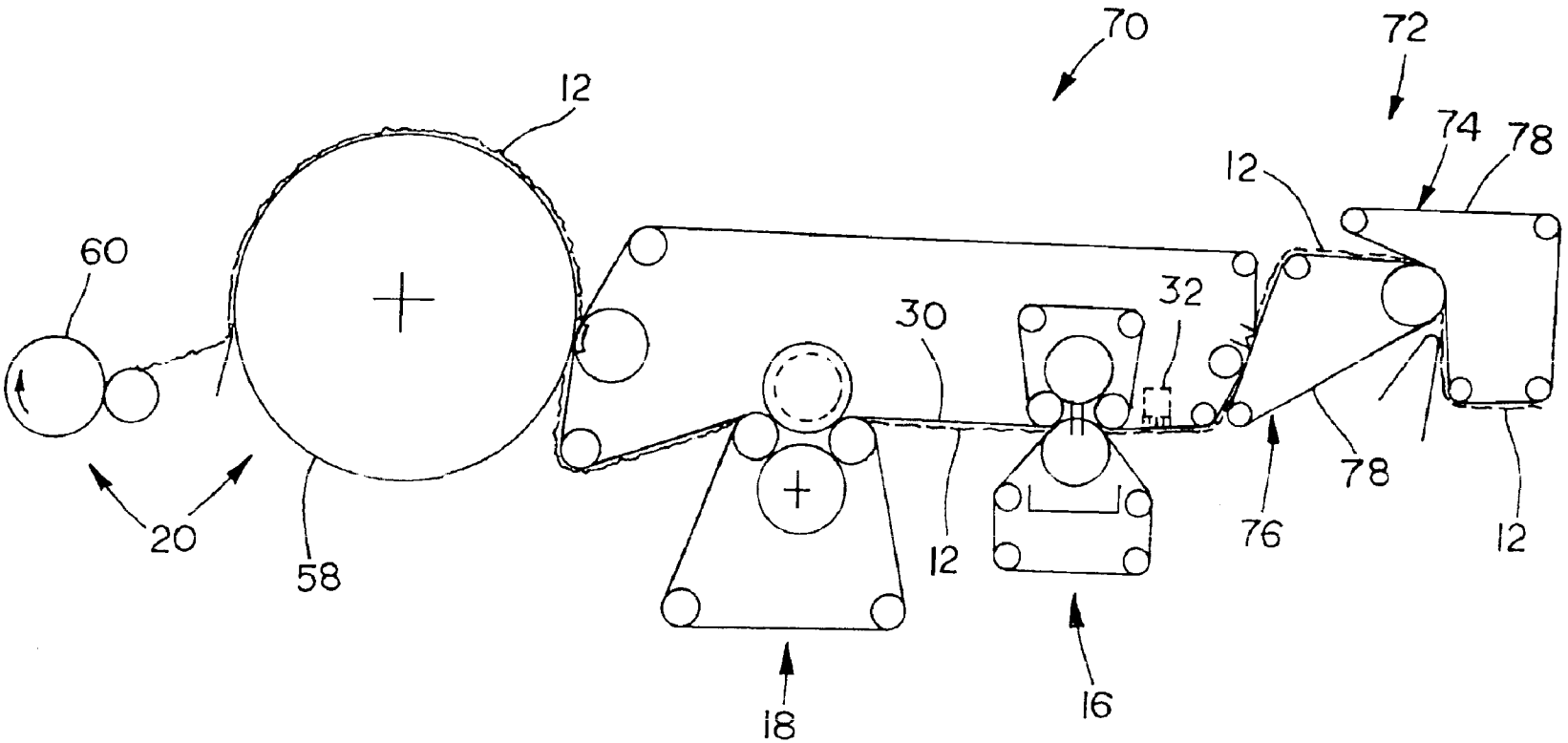
FIG. 2 is a schematic illustration of another embodiment of a paper machine of the present invention.

Referring now to FIG. 2, there is shown another embodiment of a paper machine 70 of the present invention which is similar in many respects to paper machine 10 shown and described above with reference to FIG. 1. Paper machine 70 principally differs from paper machine 10 in that paper machine 70 includes a forming section in the form of a double wire forming section, including an upstream former 74 and a downstream former 76. Each of upstream former 74 and downstream former 76 includes a wire 78 (or optionally a moulding fabric, not shown) carrying fiber web 12. After dewatering within forming section 72, fiber web 12 is successively carried to wet moulding box 32, displacement press assembly 16, TAD air press assembly 18, and additional downstream processing equipment 20, as described above with reference to FIG. 1.

Figure 5:
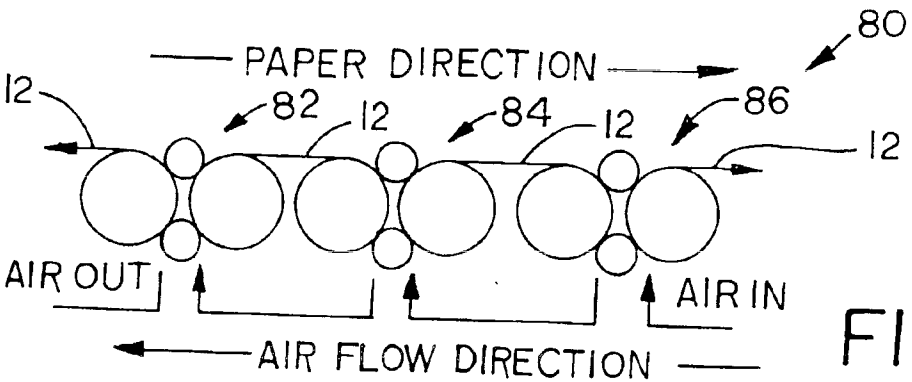
FIG. 5 is schematic illustration of another embodiment of a through air drying air press assembly which may be used in a paper machine of the present invention.

FIG. 5 illustrates another embodiment of a TAD air press assembly 80 which may take the place of the single TAD air press assembly 18 shown in FIGS. 1 and 2. TAD air press assembly 80 includes three separate TAD air presses 82, 84 and 86 which are serially arranged relative to each other. Each air press 82, 84 and 86 includes a main roll and vented roll which are horizontally arranged relative to each other, and a pair of cap rolls which are vertically arranged relative to each other. For discussion purposes, the large roll on the left of each air press is considered the main roll and the large roll on the right of each air press is considered the vented roll; however, this orientation may be easily reversed. Fiber web 12 travels between the top cap roll and the main roll, wraps around the bottom cap roll and travels between the top cap roll and the vented roll. Fiber web 12 then travels to air press 84 and subsequently to air press 86 where this same travel path exists. Thus, a double pressing action on fiber web 12 occurs within each air press 82, 84 and 86 as fiber web 12 travels the nip length corresponding to the portion of the main roll and the vented roll in contact with the high pressure air in the pressure chamber.

In contrast, the air which is introduced into the pressure chamber of each air press 86, 84 and 82 is connected together in a series arrangement in a counter current manner relative to the direction of travel of fiber web 12 (as indicated by the top and bottom arrows in FIG. 5). Hot air at a temperature of 200–600° F. (depending on the application) is introduced into the pressure chamber of air press 86. Some of the heat in the air is lost in the drying process occurring in air press 86. This cooler air is then transported in a series manner to air press 84, and subsequently to air press 82. The arrangement of TAD air press assembly 80 shown in FIG. 5 results in a high dewatering rate of fiber web 12.

During displacement pressing within displacement press assembly 16, water is removed from fiber web 12 primarily by mechanical displacement of the water as a result of the pressing action on fiber web 12. On the other hand, during through air drying of fiber web 12 in TAD air press assembly 18, dewatering occurs primarily because of evaporation as the high pressure air travels through fiber web 12. It has been found that mechanical displacement of water from a fiber web is efficient to a point. As the solids content increases, the efficiency of removing water by mechanical displacement decreases. Thereafter, dewatering primarily occurs as a result of evaporation rather than mechanical displacement. By serially arranging one or more mechanical displacement presses upstream from one or more TAD air press assemblies, a more efficient drying of fiber web 12 is achieved with the present invention.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method of dewatering a fiber web in a paper machine, comprising the steps of:

dewatering the fiber web in a forming section to a solids content of greater than approximately 10%;

displacement pressing the fiber web in an air press assembly to a solids content of greater than approximately 40%; and through air drying the fiber web in at least one air press assembly to a higher solids content.

2. The method of dewatering a fiber web of claim 1, wherein said dewatering step results in a solids content of between approximately 10 to 30%.

3. The method of dewatering a fiber web of claim 2, wherein said dewatering step results in a solids content of approximately 15%.

4. The method of dewatering a fiber web of claim 1, wherein said dewatering step is carried out using a moulding fabric with a non-flat, three dimensional surface structure.

5. The method of dewatering a fiber web of claim 1, including the further step of moulding the fiber web with a non-flat, three dimensional surface structure using a moulding fabric.

6. The method of dewatering a fiber web of claim 5, wherein said moulding step is carried out between said dewatering step and said displacement pressing step.

7. The method of dewatering a fiber web of claim 1, wherein said displacement pressing step results in a solids content of greater than approximately 45%.

8. The method of dewatering a fiber web of claim 7, wherein said displacement pressing step results in a solids content of greater than approximately 50%.

9. The method of dewatering a fiber web of claim 8, wherein said displacement pressing step results in a solids content of greater than approximately 60%.

10. The method of dewatering a fiber web of claim 1, wherein said displacement pressing step causes the fiber web to have a non-flat, three dimensional surface structure.

11. The method of dewatering a fiber web of claim 10, wherein said displacement pressing step is carried out using a moulding fabric with a non-flat, three dimensional surface structure.

12. The method of dewatering a fiber web of claim 1, wherein said displacement pressing step is carried out in an air press assembly using an impermeable membrane.

13. The method of dewatering a fiber web of claim 1, wherein said through air drying step is carried out by passing air through a permeable membrane and the fiber web.

14. The method of dewatering a fiber web of claim 13, wherein said air press assembly used to carry out said through air drying step comprises one of a cluster press, a U-shaped box, a vented roll with a hood, and a suction roll.

15. The method of dewatering a fiber web of claim 1, wherein said through air drying step is carried out with a differential pressure on opposite sides of the fiber web of greater than 2 pounds per square inch.

16. The method of dewatering a fiber web of claim 15, wherein said through air drying step is carried out with a differential pressure on opposite sides of the fiber web of between approximately 5 to 50 pounds per square inch.

17. The method of dewatering a fiber web of claim 1, wherein said through air drying step dewaters the fiber web at a rate of between approximately 400 to 950 kg water/$m^2$ hr.

18. The method of dewatering a fiber web of claim 1, wherein said through air drying step dewaters the fiber web to a solids content of at least approximately 80%.

19. The method of dewatering a fiber web of claim 1, wherein said through air drying step includes through air drying the fiber web in a plurality of serially arranged air press assemblies, said plurality of air press assemblies being fluidly connected together in a counter current manner from a downstream air press assembly to an upstream air press assembly.

20. A method of dewatering a fiber web in a paper machine, comprising the steps of:

mechanically displacing water from the fiber web in a press assembly to a solids content of greater than approximately 40%; and evaporating water from the fiber web in at least one air press assembly to a higher solids content.

21. The method of dewatering a fiber web of claim 20, including the further step of moulding the fiber web with a non-flat, three dimensional surface structure using a moulding fabric.

22. The method of dewatering a fiber web of claim 21, wherein said moulding step is carried out between said mechanically displacing step and said evaporating step.

23. The method of dewatering a fiber web of claim 20, wherein said mechanically displacing step is carried out in an air press assembly using an impermeable membrane.

24. The method of dewatering a fiber web of claim 20, wherein said evaporating step is carried out by passing air through a permeable membrane and the fiber web.

25. The method of dewatering a fiber web of claim 24, wherein said air press assembly used to carry out said evaporating step comprises one of a cluster press, a U-shaped box, a vented roll with a hood, and a suction roll.

26. The method of dewatering a fiber web of claim 20, wherein said evaporating step is carried out with a differential pressure on opposite sides of the fiber web of greater than 2 pounds per square inch.

27. The method of dewatering a fiber web of claim 26, wherein said evaporating step is carried out with a differential pressure on opposite sides of the fiber web of between 5 to 50 pounds per square inch.

28. The method of dewatering a fiber web of claim 20, wherein said evaporating step dewaters the fiber web at a rate of between approximately 400 to 950 kg water/$m^2$ hr.

29. The method of dewatering a fiber web of claim 20, wherein said evaporating step dewaters the fiber web to a solids content of at least approximately 80%.

30. The method of dewatering a fiber web of claim 20, wherein said evaporating step includes through air drying the fiber web in a plurality of serially arranged air press assemblies, said plurality of air press assemblies being fluidly connected together in a counter current manner from a downstream air press assembly to an upstream air press assembly.

31. A paper machine, comprising:

a forming section configured for dewatering the fiber web to a solids content of greater than approximately 10%;

an air press assembly configured for displacement pressing the fiber web to a solids content of greater than approximately 40%; and at least one air press assembly configured for through air drying the fiber web to a higher solids content.

* * * * *